US006025673A

United States Patent [19]

Ikeda et al.

[11] Patent Number: 6,025,673

[45] Date of Patent: Feb. 15, 2000

[54] MAGNETIC SHIELD MATERIAL, PRODUCTION METHOD THEREOF AND COLOR IMAGE TUBE ASSEMBLING THE MATERIAL

[75] Inventors: Akira Ikeda; Hironao Okayama; Toshiharu Kataoka, all of Yamaguchi, Japan

[73] Assignee: Toyo Kohan Co., Ltd., Tokyo, Japan

[21] Appl. No.: 09/029,968

[22] PCT Filed: Sep. 18, 1996

[86] PCT No.: PCT/JP96/02673

§ 371 Date: Mar. 10, 1998

§ 102(e) Date: Mar. 10, 1998

[87] PCT Pub. No.: WO97/11204

PCT Pub. Date: Mar. 27, 1997

[30] Foreign Application Priority Data

Sep. 19, 1995 [JP] Japan ..... 7-263657

[51] Int. Cl.[7] ..... H01J 29/07; C22C 38/06

[52] U.S. Cl. ..... 313/402; 313/407; 445/37; 445/47; 148/318; 148/320

[58] Field of Search ..... 313/402, 407; 445/37, 47; 148/318, 634, 320; 75/246; 252/513, 519

[56] References Cited

U.S. PATENT DOCUMENTS 5,587,027 12/1996 Tosaka et al. ..... 148/634

5,618,401 4/1997 Nomura et al. ..... 148/530

FOREIGN PATENT DOCUMENTS 57-202706 12/1982 Japan .
62-185828 8/1987 Japan .
6424364 1/1989 Japan .
3134140 6/1991 Japan .
4228549 8/1992 Japan .
6145797 5/1994 Japan .

OTHER PUBLICATIONS

Yutaka, O., Manufacture of Thick Steel Material Having Excellent Direct Current Magnetization Characteristics, *Patent Abstracts of Japan*, 014:390 May 6, 1990.

*Primary Examiner*—Nimeshkumar D. Patel
*Assistant Examiner*—Joseph Williams
*Attorney, Agent, or Firm*—Browdy and Neimark

[57] ABSTRACT

Magnetic shield materials used in color picture tubes which have excellent inner magnetic shield characteristics and an excellent handling strength, method for producing the materials and color picture tubes produced by incorporating the materials are provided. The magnetic shield materials produced by subjecting hot rolled low carbon steel strips essentially consisting of equal to or less than 0.006 weight % of C, equal to or less than 0.002 weight % of N, equal to or less than 0.5 weight % of Mn, 0.5–2.5 weight % of Si, Fe as a balance and unavoidable impurities to a cold rolling and subsequently annealing the cold rolled steel strip at a temperature of 500–700° C. and applying a nickel plating thereto after annealing.

9 Claims, No Drawings

MAGNETIC SHIELD MATERIAL, PRODUCTION METHOD THEREOF AND COLOR IMAGE TUBE ASSEMBLING THE MATERIAL

FIELD OF ART

The present invention relates to magnetic shield materials used in color picture tubes, a method of producing the materials and color picture tubes incorporating the materials, and more particularly, magnetic shield materials used in color picture tubes, a method of producing the materials and color picture tubes incorporating the materials which show an improved strength in handling.

BACKGROUND

A color picture tube such as a picture tube used in a color television set substantially comprises an electron gun and a fluorescent surface which converts electron beams into an image. The inside of the picture tube is covered with magnetic shield materials for preventing electron beams from being deflected by terrestrial magnetism.

As such magnetic shield materials, thin steel sheets on which a black treatment or a nickel plating is provided are used, wherein the thin steel sheets are formed in a desired shape by bending and they are sealed to Braun tubes at a temperature of around 600° C. The steel sheets which are used as the magnetic shield materials are required to meet favorable mechanical characteristics such as a favorable formability including bending and a handling strength capable of preventing the deformation of workpieces at the time of conveying the magnetic shield materials before or after the forming operation as well as at the time of piling the workpieces, in addition to excellent magnetic shield properties such as high permeability, low coercive force and high shield efficiency.

To decrease the coercive force while increasing the permeability, the presence of precipitation of carbon, nitrogen, carbide or nitride in the steels which impedes the movement of a ferromagnetic domain wall must be minimized and the grain growth must be promoted while decreasing the grain boundary. Although decreasing of carbon and nitrogen in the steels while increasing the grain growth of the steels provides an improvement of formability since the strength of the steels is decreased, at the time of conveying the steel sheets or workpieces which are produced by bending, they tend to suffer from irregularities even when a slight impact is applied to them or the workpieces tend to be deformed due to the weight of the workpieces piled. Although the handling strength of the steel sheets can be enhanced by grain refining or addition of a certain amount of carbon and nitrogen into the steels so as to precipitate carbide and nitride in the steels, such a method causes deterioration of magnetic characteristics. In this manner, the steel sheets used as the magnetic shield materials must simultaneously meet the excellent magnetic characteristics and the favorable handling strength which conflict with each other.

Conventionally, there have been proposed soft magnetic silicon steel sheets having an excellent handling strength as the materials which have magnetic shielding characteristics. However, such steel sheets have not been in practical use, since it is difficult to apply a black treatment required by color picture tubes to the soft magnetic silicon steel sheets. At present, as the magnetic shield materials, hyper-low carbon aluminium killed steel sheets provided with a black treatment and nickel plated steel sheets provided with a nickel plating have been practically used. Although these steel sheets have excellent magnetic shield characteristics, they do not have a sufficient handling strength.

Accordingly, it is an object of the present invention to provide magnetic shield materials having excellent inner magnetic shield characteristics and an excellent handling strength, and a method for producing such materials and color picture tubes incorporating such magnetic shield materials.

DISCLOSURE OF INVENTION

The magnetic shield materials according to the present invention are produced by subjecting hot rolled low carbon steel strips essentially consisting of equal to or less than 0.006 weight % of C, equal to or less than 0.002 weight % of N, equal to or less than 0.5 weight % of Mn, 0.5–2.5 weight % of Si, Fe as a balance and unavoidable impurities to a cold rolling, annealing the cold rolled steel strip at a temperature of 500–700° C. and providing a nickel plating thereto after annealing.

BEST MODE FOR EXECUTING INVENTION

According to the present invention, it is found that with an addition of Si to hyper-low carbon steels, the tensile strength of the hyper-low carbon steels can be held equal to or more than 40 kg/mm$^2$ while the coercive force thereof is held equal to or less than 1.2 oersted whereby the magnetic shield materials used in color picture tubes having excellent magnetic characteristics and an excellent handling strength at the same time can be obtained. The present invention is described in detail hereinafter in view of the following embodiment.

The hyper-low carbon steels used as the magnetic shield materials used in color picture tubes according to the present invention are preferably produced by subjecting the steels to decarburization and denitrization by a vacuum degassing so as to decrease carbide and nitride in the steels and subsequently subjecting the steels to a hot rolling and a continuous annealing to promote the grain growth in the steels. Furthermore, since carbide and nitride which are finely dispersed in the steels prevent the movement of a ferromagnetic domain wall and thus deteriorate the magnetic characteristics, elements which are to be included in the steels must be preliminarily restricted and the addtion amount thereof must be restricted as small as possible. Firstly, the reason for restricting kinds of elements included in the steels and the addition amount of these elements is explained.

As for C, in case where an amount of C in the cold rolled steel sheets is rich, carbide in the steels is increased so that the movement of the ferromagnetic domain wall is hindered while the grain growth is hampered. Thus, it becomes difficult to lower the coercive force of the steels. Accordingly, the upper limit of the amount of C should be 0.006 weight %. The lower limit of the amount of C should be as low as possible provided that the vacuum degassing can be effectively carried out.

As for N, in case where aluminium killed steels are used as the magnetic shield materials for the present invention, N reacts with solid-solution state aluminium in the steel to form fine AlN which deteriorates the magnetic characteristics. Accordingly, the amount of N should be equal to or less than 0.002 weight %.

As for Mn, the addition of Mn is necessary since Mn is bound to S in the steel and fixes S in the steel as MnS to prevent the hot shortness. However, since corresponding to the decrease of the amount of Mn, the magnetic characteristics are increased, the amount of Mn should be equal to or less than 0.5 weight %.

As for Si, corresponding to the increase of amount of Si, the coercive force is lowered and the magnetic shield characteristics are improved. However, the elongation is decreased and the tensile strength is increased thus lowering the formability. Although it depends on heat treatments which will be carried out after the cold rolling, with the amount of not less than 0.5 weight % of Si, the magnetic shield characteristics and the handling strength required for the present invention can be obtained, while with the amount of more than 2.5 weight % of Si, the workability and formability are deteriorated. Accordingly, the upper limit of amount of Si should be 2.5 weight %.

The production processes of thin steel sheets which can be used as the magnetic shield materials are explained hereinafter.

Firstly, hyper-low carbon hot rolled strips having the above-mentioned chemical compositions which are produced by means of vacuum refining or vaccum degassing, are subjected to pickling so as to remove an oxide film produced during a hot rolling process. Subsequently, the hot rolled steel strips are cold rolled at a rate of equal to or more than 70% so as to make the thickness of the steel strips 0.15–0.25 mm. With the cold rolling rate of less than 70%, when the steels strips are annealed after the cold rolling, the tensile strength of the strips becomes less than 40 kg/mm$^2$ so that the handling strength required by the present invention cannot be obtained. Annealing should preferably be carried out at a temperature of 500–700° C. for 3 minutes–5 hours depending on the required strength. When the annealing temperature is less than 500° C., the steel strips are not sufficiently softened so that the workability of the steel strips becomes poor. Meanwhile, with a smaller amount of Si, when the annealing temperature is high, the tensile strengh required by the present invention cannot be obtained. Furthermore, even with a sufficient amount of Si, when the annealing temperature exceeds 700° C., the tensile strength of equal to or more than 40 kg/mm$^2$ required for the present invention cannot be obtained even with a heating period of less than 3 minutes. Preferably, annealing should be carried out at a temperature of 550–650° C. for 5 minutes–2 hours corresponding to the amount of Si. Manner of annealing may either be a box annealing or a continuous annealing depending on the heating temperature and the heating time.

After carrying out the above-mentioned annealing, the steel sheets are subjected to an electrocleaning for the removal of grease and pickling in a diluted sulfuric acid so as to make the surface of the steel sheets clean and activated. Subsequently, a nickel plating is applied to the steel sheets making use of a nickel plating bath such as a Watt bath, a nickel chloride bath, sulfuric acid bath, which are commonly used in nickel plating technique. Increasing the plating amount is preferable for satisfying corrosion-resistance but the smaller amount of plating should be required in economical point of view. Terefore, the lower limit of the amount of nickel plating is 0.1 $\mu$m and the upper limit thereof is 5.0 $\mu$m.

EXAMPLE

The present invention is further explained in detail in view of the following example.

Seven kinds of steels A, B, C, D, E, F and G respectively having chemical compositions shown in Table 1 were prepared in the form of slabs by a vacuum degassing and then were subjected to a hot rolling to produce hot rolled steel sheets having a thickness of 1.8 mm. These hot rolled steel sheets were pickled in sulfuric acid and then were subjected to cold rolling to produce cold rolled steel sheets having a thickness of 0.15 mm. The cold rolled steel sheets were subjected to a continuous annealing under 15 kinds of conditions shown in Tables 2–3 to produce substrates for plating. These substrates for plating were subjected to an alkali electrocleaning for the removal of grease and were subjected to pickling in sulfuric acid. After pickling, a nickel plating having a thickness of approximately 1.3 $\mu$m was applied to respective substrates using a Watt bath having an ordinary bath composition. The coercive force of the annealed samples produced in the way mentioned was measured in such a manner that a first coil and a second coil were wound around the samples and a magnetic field of 10 oersted was applied to the samples. The tensile strength of the nickel plated steel sheets was measured by TENSILON.

Measured results are shown in Tables 2–3. It is understood that the magnetic shield materials according to the present invention has lower coercive force, and at the same time higher tensile strength so that the materials can preferably be used as the magnetic shield materials used in color picture tubes. On the contrary, Comparative Example A-1 and A-2 failed to obtain sufficient magnetic shield characteristics and a sufficient tensile strength, while Comparative Example G-1 and G-2 showed excessively high tensile strength compared to the tensile strength required for the present invention so that they had poor formability.

Because of excellent magnetic characteristics and a handling strength, the magnetic shield materials of the present invention can be used not only as inner shield materials of color picture tubes but also as frame materials which are interposed between the inner shield materials and shadow mask materials so as to fixedly secure them to panels. Sample codes (Alphabet-Number) in Tables 2 and 3 indicate magnetic shield materials produced by using kinds of materials (left portion of the material codes ) shown in Table 1 and varying conditions (right portion of the material codes).

TABLE 1

(wt %)

| kind of steel | C | N | Mn | Si | Fe |
|---|---|---|---|---|---|
| A | 0.006 | 0.002 | 0.47 | 0.10 | balance |
| B | 0.005 | 0.002 | 0.39 | 0.50 | balance |
| C | 0.006 | 0.002 | 0.42 | 1.01 | balance |
| D | 0.006 | 0.002 | 0.47 | 1.52 | balance |
| E | 0.005 | 0.002 | 0.44 | 1.99 | batance |
| F | 0.006 | 0.002 | 0.41 | 2.49 | balance |
| G | 0.006 | 0.002 | 0.42 | 3.01 | balance |

TABLE 2

| | annealing condition | | | | | |
|---|---|---|---|---|---|---|
| Sample code | tempera-ture (° C.) | time (min) | coercive force (Oe) | tensile strength (kg/mm2) | Classification | |
| A-1 | 500 | 300 | 1.22 | 18 | Example | present |
| A-2 | 700 | 3 | 1.23 | 27 | Example | invention |
| B-1 | 500 | 300 | 1.19 | 40 | Example | |
| B-2 | 700 | 3 | 1.20 | 40 | Example | |

TABLE 2-continued

| Sample code | annealing condition temperature (° C.) | time (min) | coercive force (Oe) | tensile strength (kg/mm2) | Classification |
|---|---|---|---|---|---|
| C-1 | 500 | 300 | 1.15 | 42 | Example |
| C-2 | 700 | 3 | 1.15 | 41 | Example |
| D-1 | 450 | 300 | 1.11 | 57 | Example |
| D-2 | 500 | 300 | 1.11 | 50 | Example |
| D-3 | 550 | 210 | 1.10 | 48 | Example |
| D-4 | 700 | 3 | 1.10 | 45 | Example |
| D-5 | 750 | 3 | 0.09 | 33 | Comparative Example |

TABLE 3

| Sample code | annealing condition temperature (° C.) | time (min) | coercive force (Oe) | tensile strength (kg/mm2) | Classification |
|---|---|---|---|---|---|
| E-1 | 500 | 300 | 1.07 | 60 | Example invent- |
| E-2 | 700 | 3 | 1.07 | 52 | Example ion |
| F-1 | 500 | 300 | 1.02 | 67 | Example |
| F-2 | 700 | 3 | 1.02 | 60 | Example |
| G-1 | 500 | 300 | 0.98 | 75 | Comparative |
| G-2 | 700 | 3 | 0.98 | 70 | Example |

INDUSTRIAL APPLICABILITY

The magnetic shield materials according to the present invention are magnetic shield materials used in color picture tubes which are produced by subjecting a hot rolled low carbon steel strip essentially consisting of equal to or less than 0.006 weight % of C, equal to or less than 0.002 weight % of N, equal to or less than 0.5 weight % of Mn, 0.5–2.5 weight % of Si, Fe as a balance and unavoidable impurities to a cold rolling and annealing the cold rolled steel strip at a temperature of 500–700° C. and applying a nickel plating thereto after annealing. The materials having a low coercive force have excellent magnetic shield characteristics and a high handling strength so that the materials are preferably be used as the magnetic shield materials used in color picture tubes.

We claim:

1. A magnetic shield material used in color picture tubes produced by subjecting hot rolled low carbon steel strip essentially consisting of equal to or less than 0.006 weight % of C, equal to or less than 0.002 weight % of N, equal to or less than 0.5 weight % of Mn, 0.5–2.5 weight % of Si, Fe as a balance and unavoidable impurities to a cold rolling, annealing the cold rolled steel strip at a temperature of 500–700° C. and applying a nickel plating thereto after annealing.

2. Method of producing magnetic shield material used in color picture tubes comprising subjecting a hot rolled low carbon steel strip essentially consisting of equal to or less than 0.006 weight % of C, equal to or less than 0.002 weight % of N, equal to or less than 0.5 weight % of Mn, 0.5–2.5 weight % of Si, Fe as a balance and unavoidable impurities to a cold rolling, annealing the cold rolled steel strip at a temperature of 500–700° C. and applying a nickel plating thereto after annealing.

3. A color picture tube incorporating a magnetic shield material produced by subjecting a hot rolled low carbon steel strip essentially consisting of equal to or less than 0.006 weight % of C, equal to or less than 0.002 weight % of N, equal to or less than 0.5 weight % of Mn, 0.5–2.5 weight % of Si, Fe as a balance and unavoidable impurities to a cold rolling, subsequently annealing the cold rolled steel strip at a temperature of 500–700° C. and applying a nickel plating thereto afer annealing.

4. A method according to claim 2 wherein said hot rolled low carbon steel strip is obtained by decarburization and denitrization of steel by vacuum degassing, followed by hot rolling.

5. A method according to claim 2 wherein said cold rolling is carried out at a rate equal to or more than 70% to provide the cold rolled steel strip with a thickness of 0.15–0.25 mm.

6. A method according to claim 5 wherein said annealing is carried out at a temperature of 550–650° C. for about 5 minutes to about 2 hours.

7. A method according to claim 6 wherein said nickel plating is applied in a thickness of 0.1 $\mu$m to 5.0 $\mu$m.

8. A magnetic shield material for a color picture tube comprising a low carbon steel strip consisting essentially of up to 0.006 weight % of C, up to 0.002 weight % of N, up to 0.5 weight % of Mn, 0.5–2.5 weight % of Si, and the remainder Fe and unavoidable impurities, said steel strip having a tensile strength of at least 40 kg/mm$^2$ and a coercive force no greater than 1.2 Oersted, said steel strip having a nickel plating layer thereon having a thickness of 0.1 $\mu$m–5.0 $\mu$m.

9. A color picture tube incorporating the steel strip of claim 8 as a shield material.

* * * * *